US007634829B1

(12) United States Patent
La Bar

(10) Patent No.: US 7,634,829 B1
(45) Date of Patent: Dec. 22, 2009

(54) HEAD AND CHEST SUPPORT KIT

(76) Inventor: Deborah L. La Bar, 534 Madison St., Wilkes Barre, PA (US) 18705

( * ) Notice: Subject to any disclaimer, the term of this patent is extended or adjusted under 35 U.S.C. 154(b) by 198 days.

(21) Appl. No.: 12/021,402

(22) Filed: Jan. 29, 2008

(51) Int. Cl.
*A47C 20/00* (2006.01)

(52) U.S. Cl. ..... 5/632; 5/640; 5/657

(58) Field of Classification Search ..... 5/630, 5/632, 636, 639, 640, 644, 652, 657, 655.3; 206/579
See application file for complete search history.

(56) References Cited

U.S. PATENT DOCUMENTS

| | | | | |
|---|---|---|---|---|
| 1,542,674 | A | 6/1925 | Darling | |
| 2,952,856 | A | 9/1960 | Ruff | |
| 3,140,497 | A | 7/1964 | Carswell | |
| 3,150,640 | A * | 9/1964 | Nevitt | 119/712 |
| 4,345,346 | A * | 8/1982 | Holtz | 5/640 |
| 6,131,219 | A * | 10/2000 | Roberts | 5/644 |
| 6,154,903 | A * | 12/2000 | Wai-Chung | 5/632 |
| 6,185,768 | B1 * | 2/2001 | Schlechter | 5/632 |
| 6,311,330 | B1 * | 11/2001 | Rothman | 2/69 |
| 6,922,860 | B2 | 8/2005 | Cuddy | |
| 7,020,918 | B1 * | 4/2006 | Tinsley | 5/632 |
| 2002/0104768 | A1 * | 8/2002 | Nevarez | 206/315.11 |
| 2006/0021146 | A1 * | 2/2006 | Tokarz | 5/632 |
| 2008/0178390 | A1 * | 7/2008 | DuDonis | 5/632 |

FOREIGN PATENT DOCUMENTS

GB 2070424 A * 9/1981

* cited by examiner

*Primary Examiner*—Peter Cuomo
*Assistant Examiner*—William Kelleher
(74) *Attorney, Agent, or Firm*—Crossley Patent Law; Mark A. Crossley

(57) ABSTRACT

A self-contained head and chest support kit for indoor and outdoor use, which allows a user to support his head and chest for comfort, the kit consisting of a head and chest pillow, a head pillow cover, a chest pillow cover, an adjustment strap, an air pump to inflate the head pillow and the chest pillow, and a convenient storage bag. During use for sunbathing, the head pillow supports the forehead, while the chest pillow keeps the user's spine in prior alignment, thereby also elevating the face away from the sand or ground and preventing the face from burning due to overexposure from the sun. When used for sleeping, the head pillow and chest pillow allow the neck and back muscles to lie in a more relaxed position and create a better posture. Use of the pillows in the present kit helps alleviate tension in the neck and back muscles.

19 Claims, 6 Drawing Sheets

HEAD AND CHEST SUPPORT KIT

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

FIELD OF THE INVENTION

The present invention relates to pillow devices and, more specifically, to a self-contained head and chest support kit for both indoor and outdoor use, which allows the user to support his head and chest for added comfort, the kit consisting of a head and chest pillow, a head pillow cover, a chest pillow cover, an adjustment strap, an air pump to inflate the head pillow and the chest pillow, and a convenient storage bag.

BACKGROUND OF THE INVENTION

While a variety of pillows exist in the market today, none have the specific purpose of simultaneously giving neck and back support, while also allowing adjustment of the firmness, as well as providing a convenient air pump to inflate the pillows for desired firmness and a convenient storage bag. The present head and chest support kit fills that void. The kit provides a convenient way to store and carry head and neck support pillows. In addition, a user can regulate the desired firmness, thus allowing the pillows to be adjusted to the user's constantly changing needs. The kit comes equipped with a pneumatic pump for quick and easy inflation of the head and chest pillows. The storage bag gives an excellent place to store the components and a means of carrying them.

SUMMARY OF THE INVENTION

The present head and chest support kit provides an inflatable head and chest support pillows connected together by an adjustment strap. The adjustment strap allows adjustment to an individual user's size. The present kit further consists of a pneumatic pump to inflate the head and chest pillows. The kit also consists of a storage bag to store and carry the pillows, covers, and pump. The separate head pillow and chest pillow covers help to keep a user's face and chest comfortable while lying down.

The head pillow and chest pillow are preferably constructed from durable heat-stamped vinyl, which allows for use in almost any condition. However, the pillows may also be constructed from other durable, airtight materials. When used on the beach, the head and chest support kit gives support to the head and chest when lying in a prone position. This support allows the sunbather to enjoy an added comfort giving a more relaxed sunbathing experience. The kit helps alleviate strain typically placed upon the neck and back muscles when lying in a prone position on the ground or sand. The use of the present kit also allows the forehead of the user to be elevated off the ground keeping the user's face out of the sand, dirt and grass and away from insects often embedded in the ground. The head and chest pillows allow a user's face to be kept in a straight, facedown position, thereby assisting in the prevention of a single side of the user's face from becoming overexposed to the sun. When used for sleeping purposes, the present kit helps to relax the neck and back muscles, thereby providing enhanced comfort.

One embodiment of the head pillow is inflatable to substantially 14 inches long, 5 inches wide, 5.5 inches high at its peak, and to a forehead rest portion of substantially 4 inches at the point from the surface to the lowest point of the forehead rest portion.

An embodiment of the chest pillow is oval-shaped and is inflatable to substantially 28 inches long and a 6-inch maximum height.

An embodiment of the adjustment strap is substantially 10 inches wide and provides for length adjustment.

In other embodiments the adjustability of the strap may be accomplished by using hook and loop fabric or a series of interconnecting snaps.

Other embodiments of the head and chest support pillows provide a variety of shapes and sizes, except that all embodiments of a head support pillow has a top edge having a concave center adapted to accommodate a user's forehead.

The covers for the head and chest support pillows are preferably reusable and may be constructed from microfiber, terry cloth or other similarly soft and washable materials. Each of the covers consists of an elastic band to adjust the cover to the inflated pillow.

The inflation and deflation valves may be located on the right or left sides or on the front sides of each pillow, but preferably not on the rear sides of each pillow to avoid discomfort or unanticipated opening of the valves.

As such, the general purpose of the improved head and chest support kit which has all of the advantages of the prior art mentioned heretofore and many novel features that result in an improved head and chest support kit which is not anticipated, rendered obvious, suggested, or even implied by the prior art, either alone or in combination thereof.

An object of the present head and chest support kit is to provide both head and chest support pillows having an adjustable strap therebetween for length adjustment to an individual user's size.

Another object of the present head and chest support kit is to provide head and chest support pillows which are inflatable to a desire firmness.

Yet another object of the present head and chest support kit is to be self-contained in that it provides all of the necessary components to lie on the ground in a relaxed and comfortable position.

Still another object of the present kit is to provide a head pillow, a chest pillow, an adjustable strap for adjustment of length between the head and chest pillows, a pneumatic pump to inflate the pillows, a cover for each pillow, and a storage bag for the pillows, pump, and covers.

Even another object of the present kit is to provide a comfortable, relaxed sunbathing experience.

Still even another object of the present kit is to provide a comfortable, relaxed sleeping experience.

Thus has been broadly outlined the more important features of the improved head and chest support kit so that the detailed description thereof that follows may be better understood and in order that the present contribution to the art may be better appreciated.

These together with additional objects, features and advantages of the improved head and chest support kit will be readily apparent to those of ordinary skill in the art upon reading the following detailed description of presently preferred, but nonetheless illustrative, embodiments of the improved head and chest support kit when taken in conjunction with the accompanying drawings. In this respect, before explaining the current embodiments of the improved head and chest support kit in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and kits for carrying out the several purposes of the improved head and chest support kit. It is therefore important that the claims be regarded as including such equivalent constructions insofar as they do not depart from the spirit and scope of the present invention.

Objects of the improved head and chest support kit, along with various novel features that characterize the invention are particularly pointed out in the claims forming a part of this disclosure. For better understanding of the improved head and chest support kit, its operating advantages and specific objects attained by its uses, refer to the accompanying drawings and description.

DETAILED DESCRIPTION OF THE DRAWINGS

Figure 1:
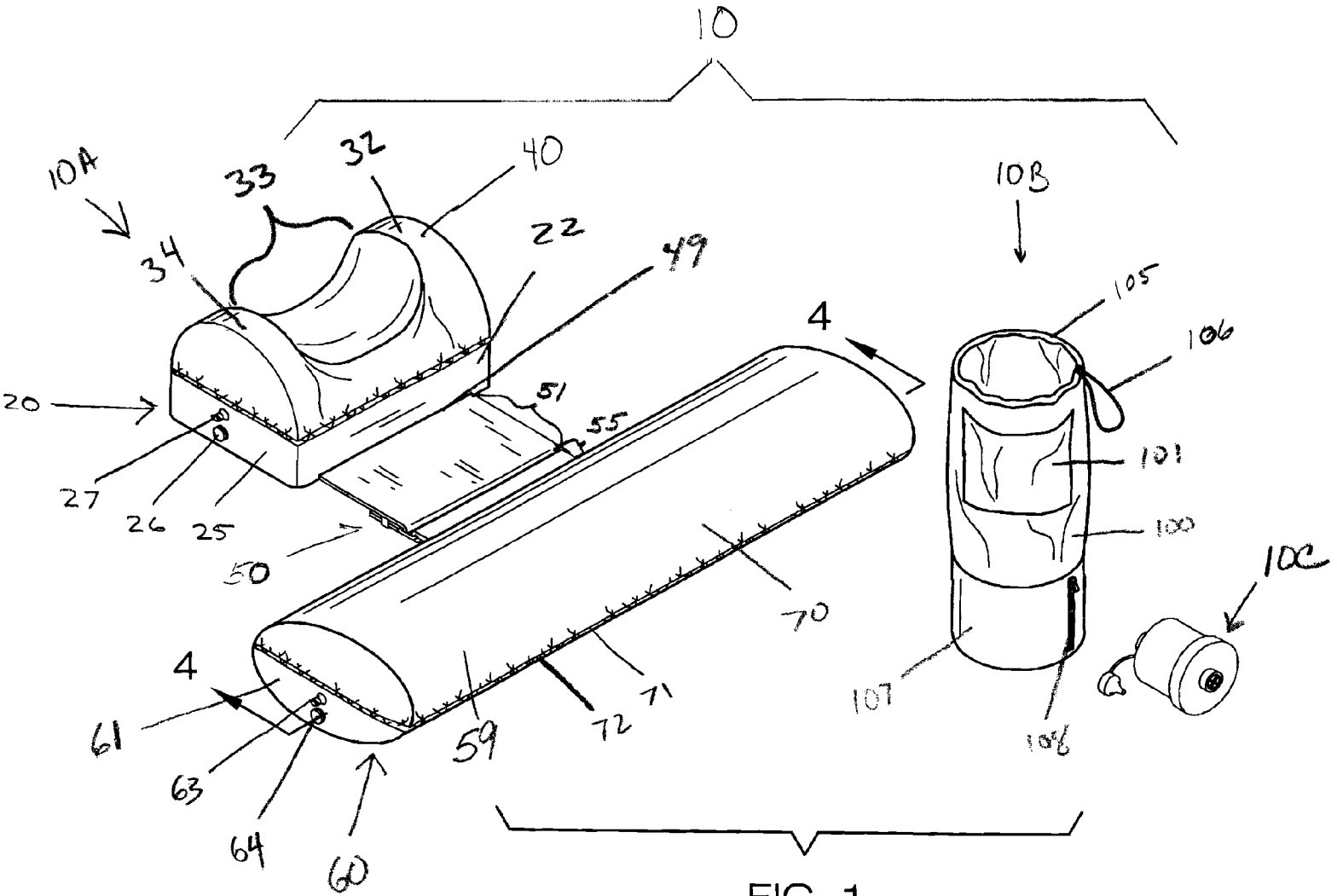
FIG. 1 is a perspective view.

With reference now to the drawings, and in particular FIGS. 1 through 6 thereof, examples of the employing the principles and concepts of the present head and chest support kit, generally designated by the reference number 10, will be described.

Referring to FIGS. 1 through 6, the present head and chest support kit 10 consists of, in combination, an inflatable head and chest support apparatus 10A, a carrying case 10B, and an inflation pump 10C. The inflatable head and chest support apparatus 10A generally consists of an head support pillow 20, an adjustment strap 50, an chest support pillow 60, a head pillow cover 40, and an inflatable chest support pillow cover 70.

Figure 2:
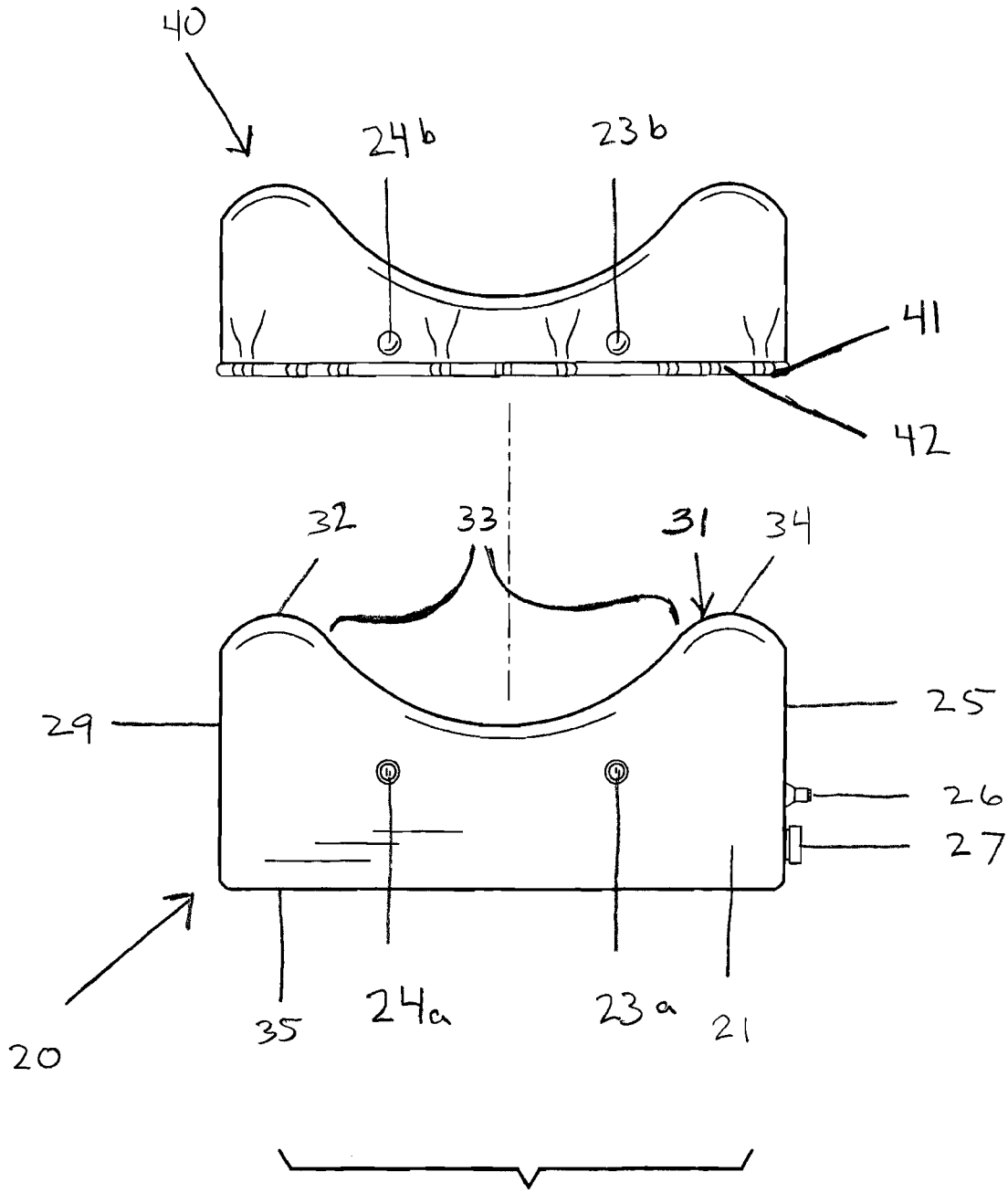
FIG. 2 is a front elevational view of a cover and a head pillow illustrating the installation of a cover onto the head pillow.
Figure 3:
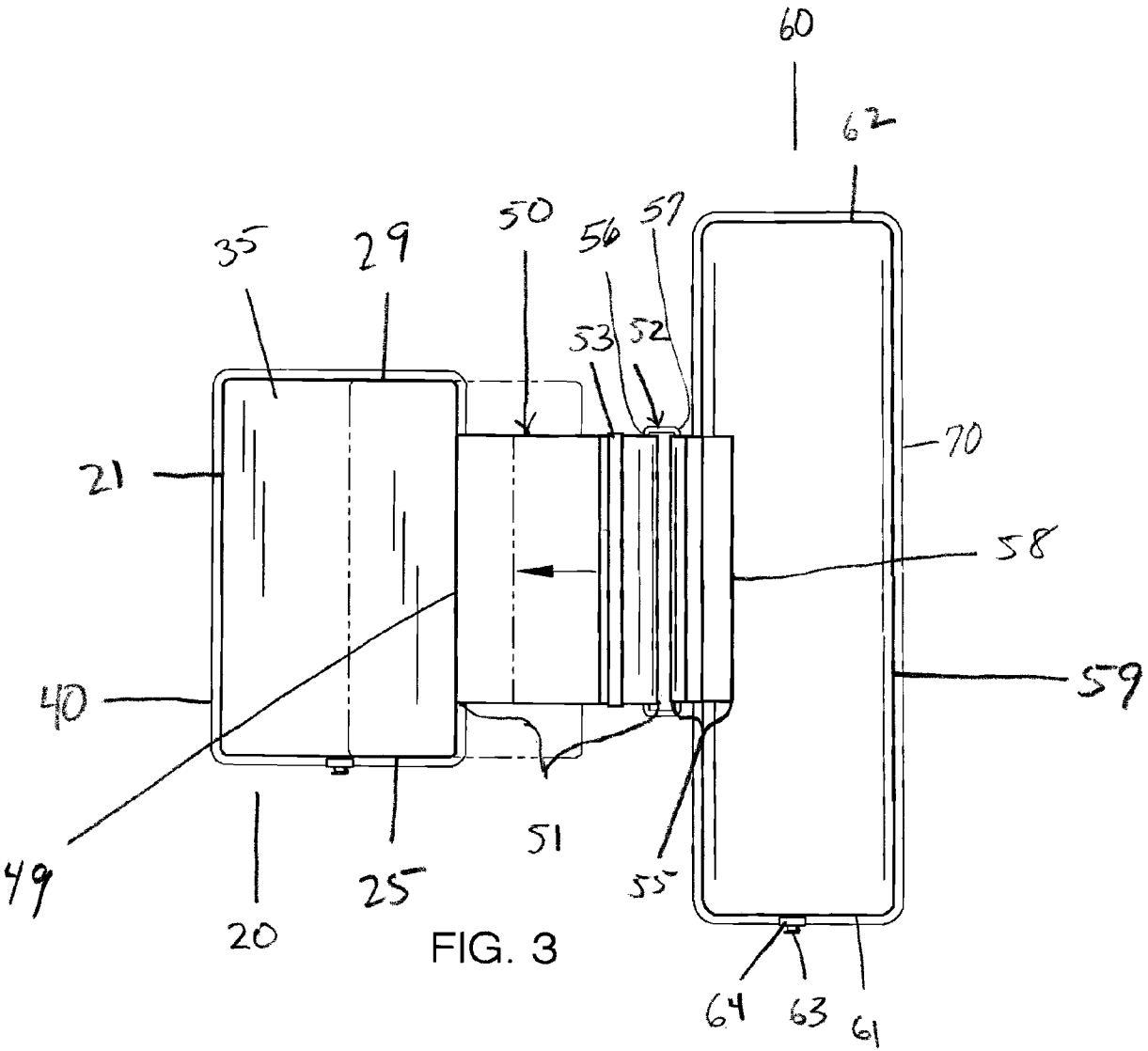
FIG. 3 is a bottom plan view of a head pillow, chest pillow and adjustment strap therebetween, illustrating size adjustment movement between the head pillow and chest pillow.

The head support pillow 20, illustrated in FIGS. 1, 2, 3, 5, and 6, is generally quonset-shaped having a front side 21, back side 22, right side 25, left side 29, topside 31 and a bottom side 35. The head support pillow 20 is inflatable. The topside 31 consists of a center portion 33, left portion 32 and right portion 34, wherein the center portion 33 is concave and the left and right portions 32, 34 are convex. The center portion 33 is adapted to accommodate the shape of a user's forehead. The front side 21 provides a first engagement means for removably engaging the head pillow cover 40. The first engagement means may be at least two male grommet pieces, a right male grommet 23*a* and a left male grommet 24*a* which removably engage at least two female grommet pieces, a right female grommet 23*b* and a left female 24*b*, respectively as illustrated in FIG. 2. The head support pillow 20 further consists of an inflation valve 26 adapted to inflate the head support pillow 20 and a deflation valve 27 adapted to deflate the head support pillow 20.

The present kit 10 provides a head pillow cover 40, illustrated in FIGS. 1, 2, 3, 5, and 6, adapted to cover the head support pillow 20. The pillow cover 40 has an elastic cord 42 therein adapted to secure the cover 40 to the pillow 20. The elastic cord 42 may run continuously along a bottom edge 41 of the cover 40 as shown in FIG. 2. The pillow cover 40 is further adapted with a means of engagement to the head support pillow 20 by a right female grommet 23*b* and a left female 24*b* respectively as illustrated in FIG. 2.

The present kit 10 further provides an adjustment strap 50, illustrated in FIGS. 1, 3, 5, and 6, adapted to connect the head support pillow 20 to the chest support pillow 60. The adjustment strap 50 is substantially rectangular. The adjustment strap 50 consists of a front section 51 having a front edge 49, a back section 55, a loop 53, and a rectangular solitary ring 52 having a left portion 56 and a right portion 57. The back section 55 is a static length of fabric, loops around the ring 52 right portion 57, folds in half to form a fixed back edge 58, which is continuously affixed to the chest support pillow 60. The front section 51 is a length of fabric, which loops over the ring 52 left portion 56, and is adjustable by passing the length of fabric under the loop 53. The front edge 49 is continuously affixed to the back side 22 of said head support pillow 20.

The chest support pillow 60, illustrated in FIGS. 1, 3, 4, 5, and 6, is generally cylindrical and has an exterior wall 59, a left end 61, and a right end 62 defining an inflatable interior cavity 60*a* therein. The chest support pillow 60 interior cavity 60*a* is divided into fluidically connected left air chamber 65, center air chamber 66, and right air chamber 67 having air proportioning valves, a left proportioning valve 68 and a right proportioning valve 69, therebetween. The chest support pillow 60 further consists of an inflation valve 63 adapted to inflate the chest support pillow 60 and a deflation valve 64 adapted to deflate the chest support pillow 60.

Figure 4:
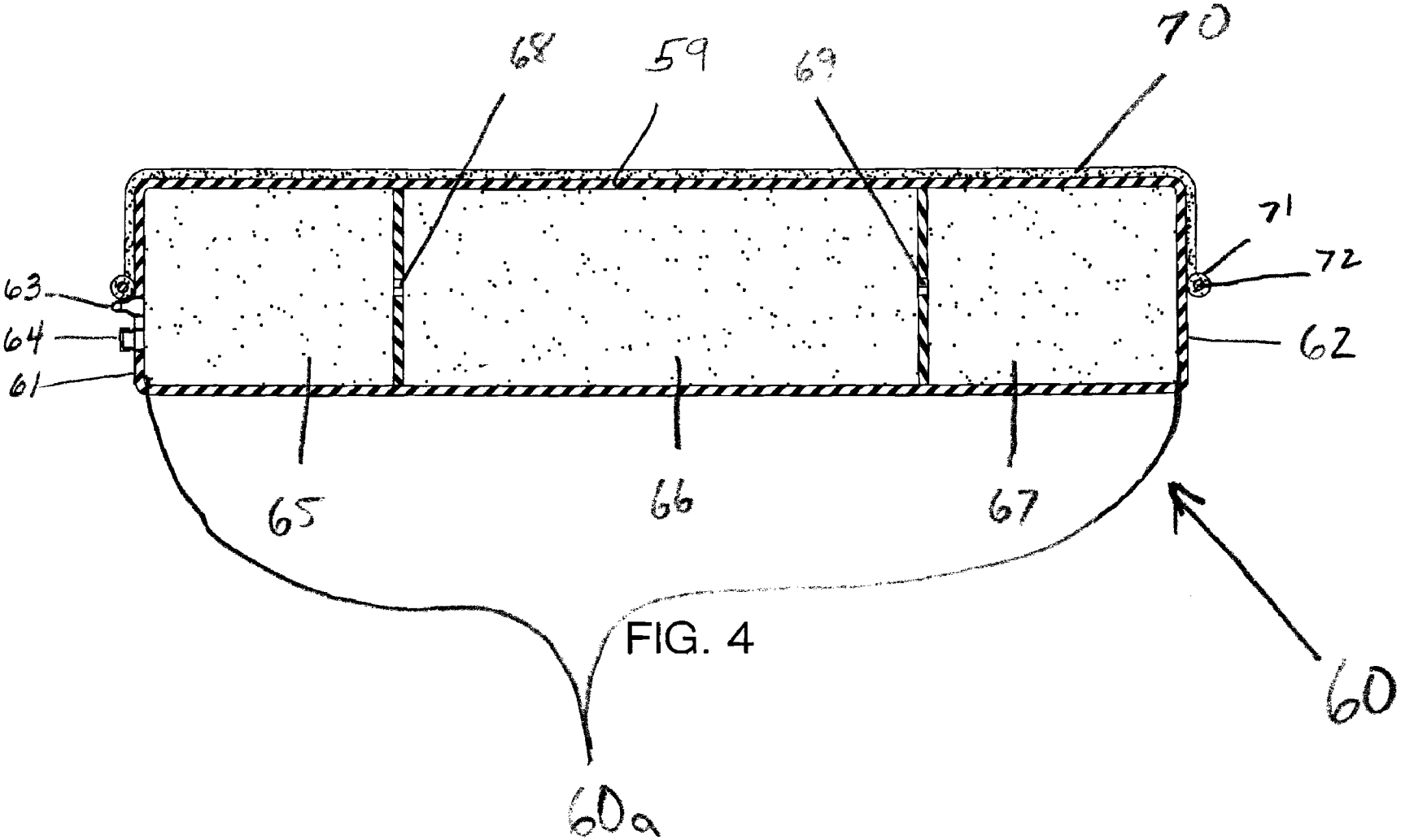
FIG. 4 is a cross-section view taken along line 4-4 of FIG. 1.

The present kit 10 provides a chest support pillow cover 70, illustrated in FIGS. 1, 2, 3, 5, and 6, adapted to cover the chest support pillow 60. The chest pillow cover 70 has an elastic cord 72 therein adapted to secure the cover 70 to the pillow 60. The elastic cord 72 may run continuously along a bottom edge 71 of the cover 70 as shown in FIG. 4. The covers 40, 70 for the head and chest support pillows 20, 60, respectively, are preferably reusable and may be constructed from microfiber, terry cloth or other similarly soft and washable materials.

A head and chest support kit 10 provides a carrying case 10B. The carrying case 10B is adapted to store and carry a deflated head and chest support apparatus 10A and an inflation pump 10C. The carrying case 10B has a top edge 105 and is divided into an upper section 100 and a lower section 107. A square pouch 101 is attached to the exterior of the carrying case 10B upper section. The carrying case 10B upper section 100 is constructed from breathable fabric, including but not limited to nylon. The carrying case 10B lower section 107 is constructed from semi-rigid, water-resistant fabric and has an internal compartment accessible via a zipper 108. The lower section 107 is used for the storage of inflation pump 10C. A draw-cord 106 is adapted to cinch the top edge 105 of the carrying case 10B.

Figure 5:
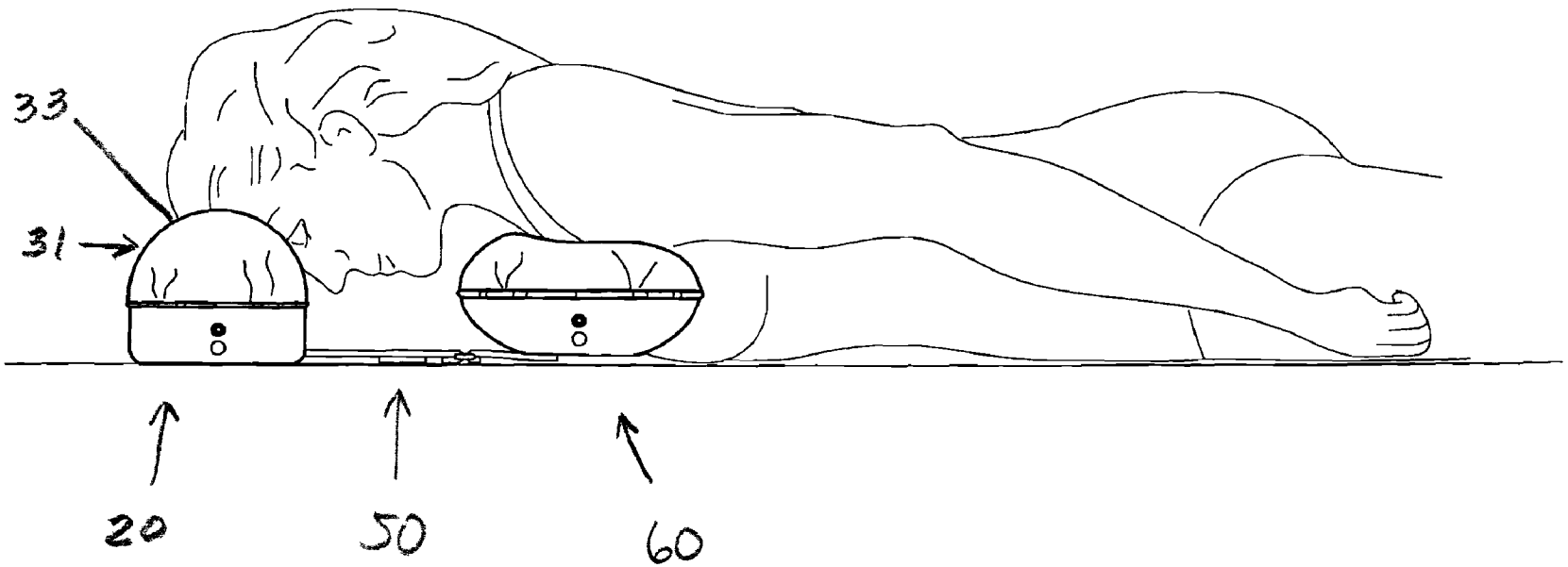
FIG. 5 is a side view illustrating exemplary use.

FIG. 5 illustrates the inflatable head and chest support apparatus 10A in use. The user is shown in a prone position with the user's head resting upon the topside 31 center portion 33 of the head support pillow 20, the user's chest supported by chest support pillow 60 thereby keeping the user's spine in proper alignment. The user's face is elevated away from the ground surface, above the adjustment strap 50.

Figure 6:
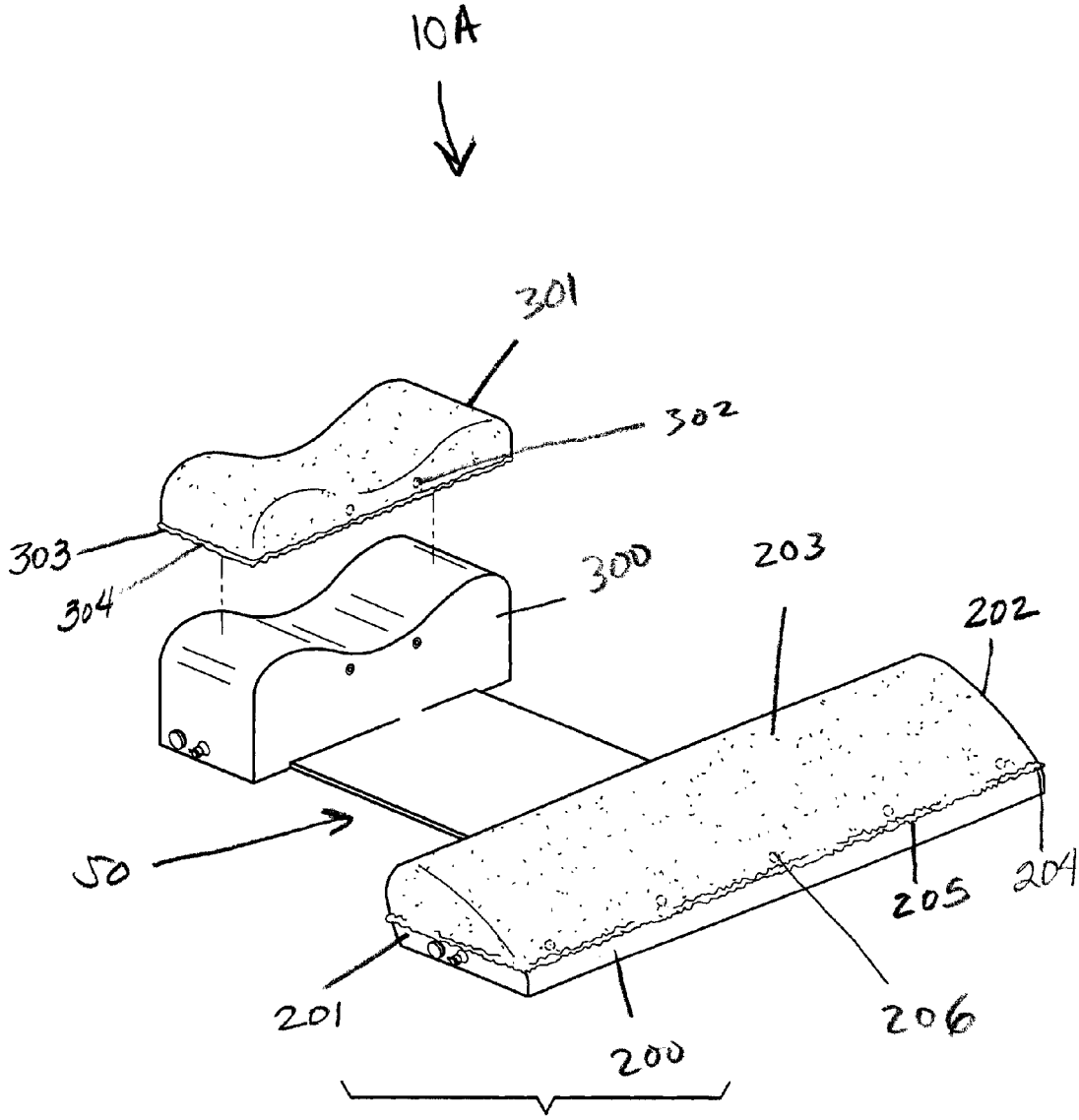
FIG. 6 is a perspective view of an alternative embodiment of the present head and chest support pillows.

FIG. 6 illustrates an alternative embodiment of the present inflatable head and chest support apparatus 10A providing a generally cylindrical exterior, triangular chest support pillow 200, triangular left side 201, and triangular right side 202 defining an interior inflatable compartment. Adapted to cover the triangular chest pillow 200 is a triangular chest pillow cover 203. The triangular chest pillow cover 203 has an elastic cord 204 therein adapted to secure the cover 203 to the pillow 200. The elastic cord 204 may run continuously along a bottom edge 205 of the cover 203 as shown in FIG. 6. The pillow cover 203 is further adapted with a means of engagement to the triangular chest support pillow 200 by a plurality of grommets 206 respectively as illustrated in FIG. 6. Further the alternative embodiment of the present inflatable head and chest support apparatus 10A provides a saddle shaped head pillow 300 and a saddle shaped head pillow cover 301 adapted to cover saddle shaped head pillow 300. The saddle shaped head pillow cover 301 has a plurality of grommets 302 adapted as a means of engaging the pillow cover 301 to the pillow 300. The saddle shaped pillow cover 301 further has elastic cord 303 therein adapted to secure the cover 301 to the pillow 300. The elastic cord 303 may run continuously along a bottom edge 304 of the cover 301 as shown in FIG. 6.

With respect to the above description then, it is to be realized that the optimum dimensional relationships for the parts of the head and chest support kit, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A head and chest support kit comprising:

a head and chest support apparatus comprising:

a quonset-shaped inflatable first pillow adapted to support a forehead, said pillow having a front side, a back side, a right side, a left side, a top side, and a bottom side wherein said front side further has a first means of engagement adapted to removably engage said pillow to a pillow cover;

wherein said topside comprises a convex left portion, a convex right portion, and a concave center portion therebetween, said center portion adapted to accommodate a user's forehead;

wherein said right side contains an inflation valve and a separate deflation valve adapted to inflate and deflate, respectively, said first pillow;

a substantially rectangular adjustment strap having a front section having a front edge, a back section comprising a static length of fabric and having a back edge, a loop, and a rectangular solitary ring having a left portion and a right portion, wherein said back section loops around said ring right portion, folds in half to form said fixed back edge which is continuously affixed to a second pillow and further wherein said front section front edge is continuously affixed to said first pillow back side, a generally cylindrical second pillow adapted to support a chest, said second pillow having an exterior wall, a left end, a right end, said exterior wall, left end and right end defining an interior cavity, said interior cavity having a plurality of fluidically connected air chambers, wherein a left air proportioning valve and a right air proportioning valve provided between said air chambers to allow air to pass between said chambers;

a first pillow cover adapted to cover said first pillow, said first pillow cover having a bottom edge and an elastic cord running continuously along said bottom edge;

a second pillow cover adapted to cover said second pillow, said second pillow cover having a bottom edge and an elastic cord running continuously along said bottom edge;

a carrying case adapted to store and carry said head and chest support apparatus and an inflating pump, said carrying case comprising:

an upper section having a top edge, a semi-rigid, water-resistant lower section affixed to the bottom of said upper section;

a zipper adapted to provide access to said lower section;

a draw cord running continuously along said upper section top edge, said draw cord adapted to cinch said upper section;

an inflation pump adapted to inflate said first pillow and said second pillow.

2. The head and chest support kit of claim 1 wherein said first means of engagement is at least two male grommet pieces on said first pillow front side and at least two female grommet pieces on said first pillow cover adapted to removably engage said two male grommet pieces.

3. The head and chest support kit of claim 1 wherein said plurality of air chambers comprise a right air chamber, a left air chamber, and a center air chamber therebetween.

4. The head and chest support kit of claim 1 wherein said first means of engagement is at least two male grommet pieces on said first pillow front side and at least two female grommet pieces on said first pillow cover adapted to removably engage said two male grommet pieces and further wherein said plurality of air chambers comprise a right air chamber, a left air chamber, and a center air chamber therebetween.

5. The head and chest support kit of claim 1 wherein said first pillow cover and said second pillow cover are constructed from soft, washable fabric.

6. The head and chest support kit of claim 2 wherein said first pillow cover and sand second pillow cover are constructed from soft, washable fabric.

7. The head and chest support kit of claim 3 wherein said first pillow cover and said second pillow cover are constructed from soft, washable fabric.

8. The head and chest support kit of claim 5 wherein said soft, washable fabric is microfiber fabric.

9. The head and chest support kit of claim 5 wherein said soft, washable fabric is terrycloth.

10. The head and chest support kit of claim 6 wherein said soft, washable fabric is microfiber fabric.

11. The head and chest support kit of claim 6 wherein said soft, washable fabric is terrycloth.

12. The head and chest support kit of claim 7 wherein said soft, washable fabric is microfiber fabric.

13. The head and chest support kit of claim 7 wherein said soft, washable fabric is terrycloth.

14. A head and chest support kit comprising:

a head and chest support apparatus comprising:

a saddle-shaped inflatable first pillow adapted to support a forehead, said pillow having a front side, a back side, a right side, a left side, a top side, and a bottom side wherein said front side further has a first means of engagement adapted to removably engage said pillow to a pillow cover;

wherein said topside comprises a convex left portion, a convex right portion, and a concave center portion therebetween, said center portion adapted to accommodate a user's forehead;

wherein said right side contains an inflation valve and a separate deflation valve adapted to inflate and deflate, respectively, said first pillow;

a substantially rectangular adjustment strap having a front section having a front edge, a back section comprising a static length of fabric and having a back edge, a loop, and a rectangular solitary ring having a left portion and a right portion, wherein said back section loops around said ring right portion, folds in half to form said fixed back edge which is continuously affixed to a second pillow and further wherein said front section front edge is continuously affixed to said first pillow back side, a generally cylindrical triangularly-shaped second pillow adapted to support a chest, said second pillow having an exterior wall, a left end, a right end, said exterior wall, left end and right end defining an interior cavity, said interior cavity having a plurality of fluidically connected air chambers, wherein a left air proportioning valve and a right air proportioning valve provided between said air chambers to allow air to pass between said chambers;

a first pillow cover adapted to cover said first pillow, said first pillow cover having a bottom edge and an elastic cord running continuously along said bottom edge;

a second pillow cover adapted to cover said second pillow, said second pillow cover having a bottom edge and an elastic cord running continuously along said bottom edge;

a carrying case adapted to store and carry said head and chest support apparatus and an inflating pump, said carrying case comprising:

an upper section having a top edge, a semi-rigid, water-resistant lower section affixed to the bottom of said upper section;

a zipper adapted to provide access to said lower section;

a draw cord running continuously along said upper section top edge, said draw cord adapted to cinch said upper section;

an inflation pump adapted to inflate said first pillow and said second pillow.

15. The head and chest support kit of claim 14 wherein said first means of engagement is at least two male grommet pieces on said first pillow front side and at least two female grommet pieces on said first pillow cover adapted to removably engage said two male grommet pieces and wherein said second pillow has a second means of engagement.

16. The head and chest support kit of claim 14 wherein said second pillow cover further comprises a plurality of female grommet pieces above said elastic cord and said second pillow comprises a plurality of male grommet pieces adapted to engage said second pillow cover female grommet pieces.

17. The head and chest support kit of claim 14 wherein said first pillow cover and said second pillow cover are constructed from soft, washable fabric.

18. The head and chest support kit of claim 17 wherein said soft, washable fabric is microfiber fabric.

19. The head and chest support kit of claim 17 wherein said soft, washable fabric is terrycloth.

* * * * *